United States Patent [19]

Westin

[11] Patent Number: 4,569,823

[45] Date of Patent: Feb. 11, 1986

[54] POWDER METALLURGICAL METHOD

[75] Inventor: Leif Westin, Söderfors, Sweden

[73] Assignee: Kloster Speedsteel Aktiebolag, Soderfors, Sweden

[21] Appl. No.: 592,613

[22] Filed: Mar. 23, 1984

[30] Foreign Application Priority Data

May 9, 1983 [SE] Sweden ..... 8302639

[51] Int. Cl.[4] ..... B22F 3/16; B22F 7/00

[52] U.S. Cl. ..... 419/23; 419/30; 419/57; 419/60

[58] Field of Search ..... 419/23, 30, 26, 57, 419/60

[56] References Cited

U.S. PATENT DOCUMENTS 4,011,051 3/1977 Helton et al. ..... 419/23

OTHER PUBLICATIONS

Hultgren, "Fundamentals of Physical Metallurgy", Prentice-Hall, Inc., N.Y., pp. 220 & 221, 1952.

*Primary Examiner*—Allan M. Lieberman

*Attorney, Agent, or Firm*—Fred A. Keire

[57] ABSTRACT

A powder metallurgical method of producing metal bodies using spherical powder, produced by inert gas atomization, from magnetizable material with a particle size distribution closely approximating the so called Fuller curve for maximum density packing of spherical particles. Said powder is magnetized and filled into a form, which may take place before or after magnetization, said mixed and magnetized powder then sintered in said form with the exclusion of air, to produce a sintered body without communicating porosity.

8 Claims, 4 Drawing Figures

POWDER METALLURGICAL METHOD

TECHNICAL SCOPE

The invention relates to a method within powder metallurgy to produce metallic bodies. Specifically, the invention relates to a method comprising sintering of powder, to produce a sinter body without communicating porosity.

PRIOR ART

One well known method of producing billets from quality steel with a tendancy for segregation, such as high speed steel, is the so called ASP®-method. This method comprises melting, atomization by inert gas to produce a spherical powder with low content of oxides, encapsulating said powder, and compacting said powder isostatically in the cold state and in the warm state. Thereafter the billets are forged and/or rolled and heat treated in a conventional way. The ASP®-steel is characterised from a point of view of material by its isotropy, a homogeneous composition, and fine grain structure. The powder metallurgic co-technique makes it possible to avoid completely the problem of inhomogeneous structure and composition (macrosegregation) which occurs when high speed steel billets are produced conventionally by moulding ingots. One drawback of the ASP®-process is that the powder cannot be pressed to form a coherent green body. This is because the powder is mainly martensitic (about 60%) and because the particles are spherical. This means that the powder must be encapsulated before the isostatic compacting in the cold and in the warm state, which is costly.

There has also been developed a process beside the ASP®-process to make semi-finished products (wire, strip steel, bar steel) from water-atomized powder. The advantage of using water instead of gas to atomize the molten steel is that the powder produced with water contains grains of a highly irregular shape, which makes it possible to compact the powder without encapsulating it, reducing the overall cost of the process. The atomization as such is cheaper with water than with inert gas. One important drawback of atomization with water is that the oxygen content of the powder is raised. Attempts to solve this problem have been made, e.g. by annealing the powder in an atmosphere of reducing hydrogen gas. This requires an addition of carbon to the powder after the annealing and this easily causes an uneven distribution of carbon in the powder, and therefore also in the finished produced. The carbide structure easily becomes uneven. Products made from powder which is atomized with water must be considered of a substantially lower quality than products produced from gas-atomized powder.

A process has also been developed to produce metal bodies, especially high speed tools, and other products from super-alloys to near finished form by high temperature sintering, the so called Fuldensprocess. This process is based on the discovery that press bodies from high speed steel powder and the like may be sintered to full density at temperatures around 250°-300° C. The optimal temperature temperature for sintering is a function of the composition of the alloy. If the sintering temperature is too low, pores will remain in the material, and if it is too high, the structure will be unfavourable with coarse carbides. Another limitation to the method is that it presupposes the possibility of making a green body, i.e. a body produced by pressing a plastically deformable powder. The normal method of producing a powder which is fine grained, ductile and willing to sinter, is by atomizing molten steel with a a jet of water, grinding the powder, and annealing it in a hydrogen atmosphere to reduce oxygen content and hardness. It is possible to obtain a material which may be sintered from a spherical powder obtained in a process with gas atomization, if the powder is ground and annealed before pressing. The mechanical grinding is, however, expensive, which makes this method competitive only in the production of goods close to finished form, costs prohibiting its use for the production of billets to be rolled or in other ways deformed plastically before establishing the final form of the product by conventional cutting.

DISCLOSURE OF THE INVENTION

The purpose of the invention is to offer a method to make metal bodies from powdered metal in an economically advantageous way. In particular a purpose of the invention is to provide a method which is cheap enough to be used for the production of billets which are intended to be further machined by shaping or cutting.

Another purpose of the invention is to provide a method for making products of high quality, including low oxygen content and small homogeneously disposed carbides. This means for example that the diameter of the carbides shall be no greater than 10 μm.

This and other purposes may be obtained by mixing at least two fractions from a spherical powder of magnetizable material atomized by inert gas, said fractions having average particle sizes considerably different, the proportions of the fractions to be mixed so chosen that the mixture obtains a distribution of particle sizes which approximates the so called Fuller-curve for maximum density packing of spherical particles, said powder then being magnetized, poured into a form, and densily packed by vibrating or beating against said form. The powder having been mixed and magnetized in said manner is then sintered in said form with air excluded, to produce a sintered body without communicating pores.

This method has been developed mainly for the production of high speed steel billets, but may be used also for the production of billets for tool steel, alloys based on cobalt as well as other magnetizable materials.

The invented method may be applied to the production of products of a near finished form. In this case the method comprises a subsequent isostatical compacting of the produced sintered body in the warm state, which becomes possible since the body lacks communicating pores. The method as such may be combined with isostatic compacting in the warm state even if the purpose is to produce billets for further forming or cutting.

It is also possible according to the invented method to include in the mixture fine grains of hard substances such as different carbides, nitrides and/or borides.

The separate steps of the method according to the invention may be carried out in different ways. One of the conditions for the method is the correct choice of initial powder. The powder must be atomized by inert gas so that the particles are spherical. The atomization gas may be argon and/or nitrogen. The grain size of the powder is determined by the choice of gas nozzle and by the arrangement of the gas nozzles. The powder may be divided into a large number of fractions. These fractions are mixed in such mass proportions that the size distribution of the particles in the mixture is close to the ideal so called Fuller-curve. This curve, which describes a continuous distribution of particle sizes, corresponds to maximum density packing. It is, however, possible to obtain packing of high density from discontinuous particle size distribution if the fractions are such that the particles of the finer fractions fill the empty spaces between the particles of the coarser fraction. In general it is possible to obtain higher density if more fractions are combined. It has been found during the development of the method according to the invention that it is possible to obtain a sufficient density already with two fractions. One of the fractions is the so called production powder, which is obtained when atomizing a molten metal with inert gas, which is normally used to produce billets in the so called AS®-process (as mentioned above), while the other fraction may be a fine fraction which has been separated in a cyclone as the inert gas has been recirculated. This fraction, generally called cyclone powder, is a by-product of no particular use in the ASP®-process.

The proportions of the different fractions in the mixture are dependent firstly on the average particle size of each fraction but also on the mesh number or size interval of each fraction. It was found that at a certain mean particle size the relation between the mean particle sizes of the two fractions should be 10, indicating that generally the mean particle size relation in a two fraction mixture should be between 5 and 15. The investigations have also shown that a mixture of two fractions should consist of between 15 and 40, suitably between 20 and 35, preferably about 25% per weight of fine parts fraction, the rest being the coarser fraction, if the mean particle size relation of the fractions is between 5 and 15. The investigations have also indicated that a packing becomes denser, i.e. the Fuller-curve is approximated better, if the coarse fraction is comparatively coarse. For example there was obtained a better result when the coarser parts fraction had a maximum particle size of between 1 and 1.5 mm than if it had a maximum particle size of between 0.5 and 1.0 mm.

It is possible to mix the powder fractions in any conventional mixer, such as a rotating drum, a screw conveyor, or the like. After mixing the powder is magnetized (the powder may be magnetized before the mixing). It is easy to magnetize the powder to saturation. In other words the magnetization is not a critical part of the process, i.e. it is not a parameter which is difficult to control. For example the powder may be transported through a pipe of non-magnetizable material inside a magnetic coil. If the magnetic field strength and the powder flow rate are high, the powder may stagnate in the pipe. To eliminate this effect it is possible to let the magnetic field pulsate, so that the powder is forwarded slightly between each pulse by its own weight. A prerequisite for this is that the flow of the powder is vertical, the powder falling down through the magnetic coil. It is possible also to feed the powder mechanically, e.g. by a feed screw or a piston pump. Another way of magnetizing the powder is by transporting it on a conveyered belt of rubber or some other non-magnetizable material over a magnet, arranged under said belt.

The mixed, magnetized powder is filled into a form. In case the object is to produce a billet intended for further machining by shaping and/or cutting, the form is cylindrical. Ceramic pipes are suitable as forms, because when the powder body shrinks when sintered, it is easy to strip the sintered body from the form, the form therefore being re-usable. In principle, however, it is also possible to use a metal sheet form. It is also possible to carry out the magnetization after having put the powder into the form, if said form is non-magnetizable.

If the intent is to produce near finished goods, the mixed, magnetized powder is filled into a form with a forming surface approximately that of the desired product. In order that the form may be re-used, it might be suitable to let it consist of two or more parts and possible cores.

When the desired amount of mixed, magnetized powder has been filled into the form, the powder is packed by vibration, shaking, wrapping or the like. As a result of the magnetization an effect is avoided which will occur when dense packing is attempted of a mixture of powder, namely that powders of different sizes are deposited in different layers. This is normal when vibrating or otherwise treating a powder in order to pack it densely. By magnetizing the powder the desired homogenisation is obtained. The fact that the magnetic field strength is increased as the particle size is increased provides for an ideal distribution and retained, optimal filling density at the ideal mixture of fractions. This is because the smaller particles are pushed into the space between the larger particles by the packing process and are retained there as a result of the stronger magnetic field of the larger particles.

The most critical part of the process is the sintering of the magnetized, densely packed powder. Thus, the temperature must be high enough to accomplish sintering of the powder particles to a degree which eliminates all communicating porosity, but must not be too high, since this produces an unfavourable structure with coarse carbides. The method according to the invention is not as demanding in this respect, however, as the method mentioned earlier to produce fully dense bodies by sintering a fine grained, water atomized, and mechanically comminuted powder. Such a powder must be sintered at a high temperature and in order to produce high speed steel with the required properties sintering must be carried out in a very narrow temperature interval of about 10° C. within the temperature area of 1250°–1300° C. The method according to the invention makes it possible to work within a temperature interval which is more suitable for the alloy at hand within a lower temperature area, 1200°–1250° C., and yet obtain the required density of filling after sintering, as a result of the higher relative density which is obtained by mixing the fractions and magnetizing the mixture. To entirely avoid communicating porosity, density after sintering should be at least 95%. It is suitable to work closely to the solidus temperature of the material, in other words at a temperature within ±25° C. of the solidus temperature. Another factor which simplifies the process control is that the sintering effect is not critically dependent on the sintering temperature. Thus, the sintering time may be extended to several hours (1–5 hours). This makes it easier to control the temperature and keep it level than if the material were to be sintered during a comparatively short time, which would require a higher rate of heating and consequently cause greater difficulties in controlling the temperature within a narrow interval.

Sintering is carried out in a vacuum oven or possibly in nitrogen gas, in case absorption of nitrogen into the material is tolerable or desirable. In principle the sintering may also be carried out in a molten salt, but this would be more of a theoretical than of a practical interest because of among other things the explosion risk.

After sintering to obtain a density of at least 95% and a subsequent stripping a metal body has been produced with a surface quality equal to that of the form which may be hot rolled or forged to full density. Full density may also be obtained by a subsequent isostatic compacting in the warm state. The latter alternative may become especially interesting when near finished goods are being produced.

Further characteristics and aspects of and purposes and advantages of the invention will be apparent from the following description of a preferred embodiment and experiments carried out and from the patent claims to follow.

BRIEF DESCRIPTION OF DRAWINGS

In the following description of the preferred embodiment and of the experiments which have been made, reference will be made to the attached drawings, of which FIG. 1 in the form of a block diagram illustrates one possible way of carrying out the method according to the invention.

DESCRIPTION OF THE PREFERRED EMBODIMENT AND OF EXPERIMENTS

Figure 1:
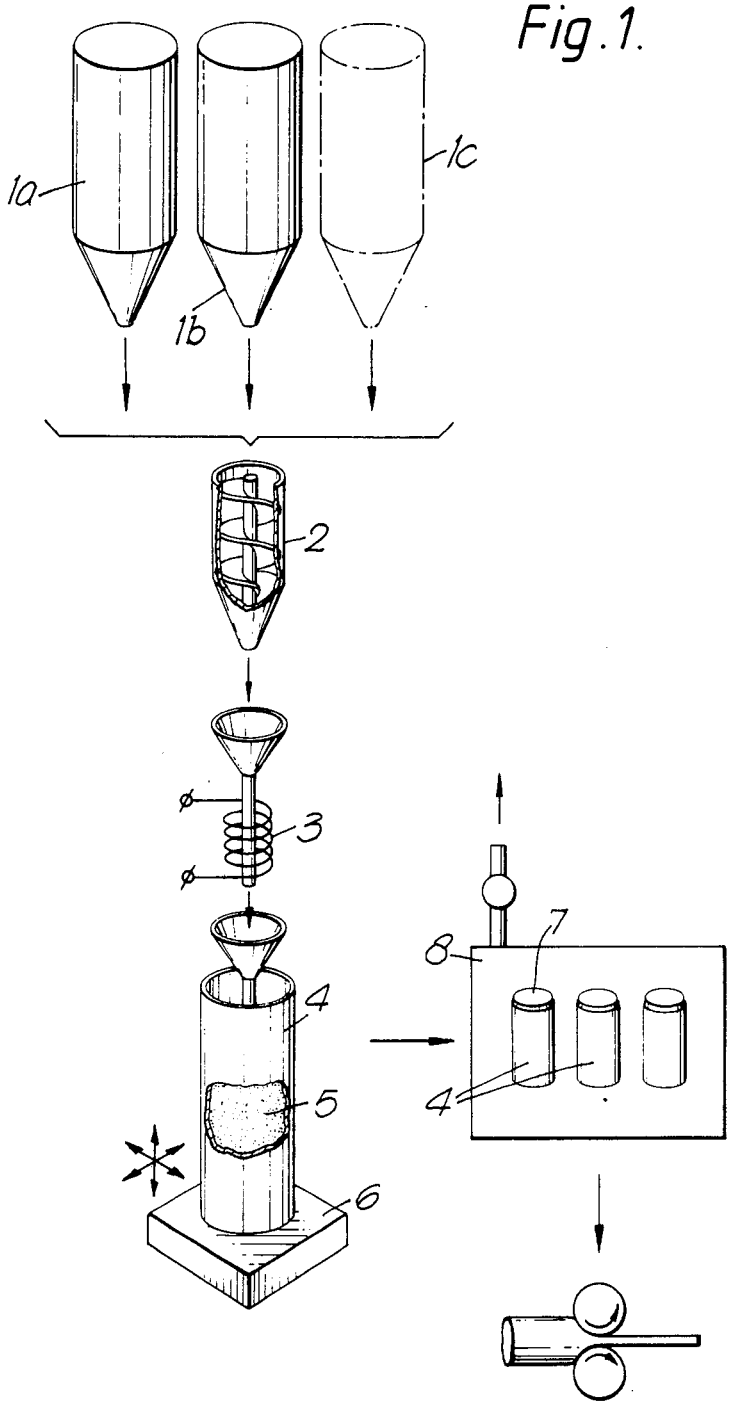

Referring to FIG. 1 there are indicated a number of bins, 1*a*, 1*b*, 1*c*, containing metal powder from different fractions of particle size. The powder has been produced by granulating with inert gas, and is thus spherical, has a mainly martensitic structure, and a low content of oxygen. The powder fractions are mixed in a mixer 2 in proportions which have been determined beforehand. Then the mixed powder is fed through an electro magnet 3, magnetizing the powder particles to saturation. The magnetized powder is filled into a form, which is a ceramic pipe 4. The powder 5 in the pipe 4 is packed, the pipe 4 being placed on a vibrating plate 6 or the like, packing the powder 5 densely. The pipe 4 is then covered with a bonnet 7, and a number of such pipes are put in a vacuum oven 8. The oven is evacuated, and the pipes 4 with content are heated to a temperature determined in advance which for high speed steel is within the temperature area 1200°–1250° C. The powder bodies are kept at this temperature for a time of 1–5 hours or as long as has been determined empirically is necessary to cause the sintering of the powder particles eliminating communicating porosity. This means increasing the relative density by sintering from about 73–74% to at least 95%. This also causes the sintered body to shrink, which makes it easy to remove it from the ceramic pipe 4, which may therefore be re-used several times. The finished sintered body has a smooth surface and may after being heated to rolling temperature be hot formed to full density, i.e. 100% relative density.

EXPERIMENT 1

The starting material was an inert gas atomized high speed steel powder of the ASP®-23 type with 1.27% C, 4.2% Cr, 5.0% Mo, 6.4% W, 3.1% V, the rest being Fe.

The average particle size was 120 μm and the maximum particle size was 800 μm. The fraction of the finest parts obtained by inert gas atomizing, the so called cyclone powder with particle sizes less than 100 μm, was removed in a conventional way. More specifically, the used powder was of the type used to produce ASP®-steel.

The powder was poured into a ceramic pipe, packed by light shaking, and sintered at about 1230° C. The cylindrical body obtained in this way had a rough surface with very coarse areas mixed with streaks of finer surface. The experiment shows that powder from different size particles is layered in the container and is impossible to pack densely.

EXPERIMENT 2

Figure 2:
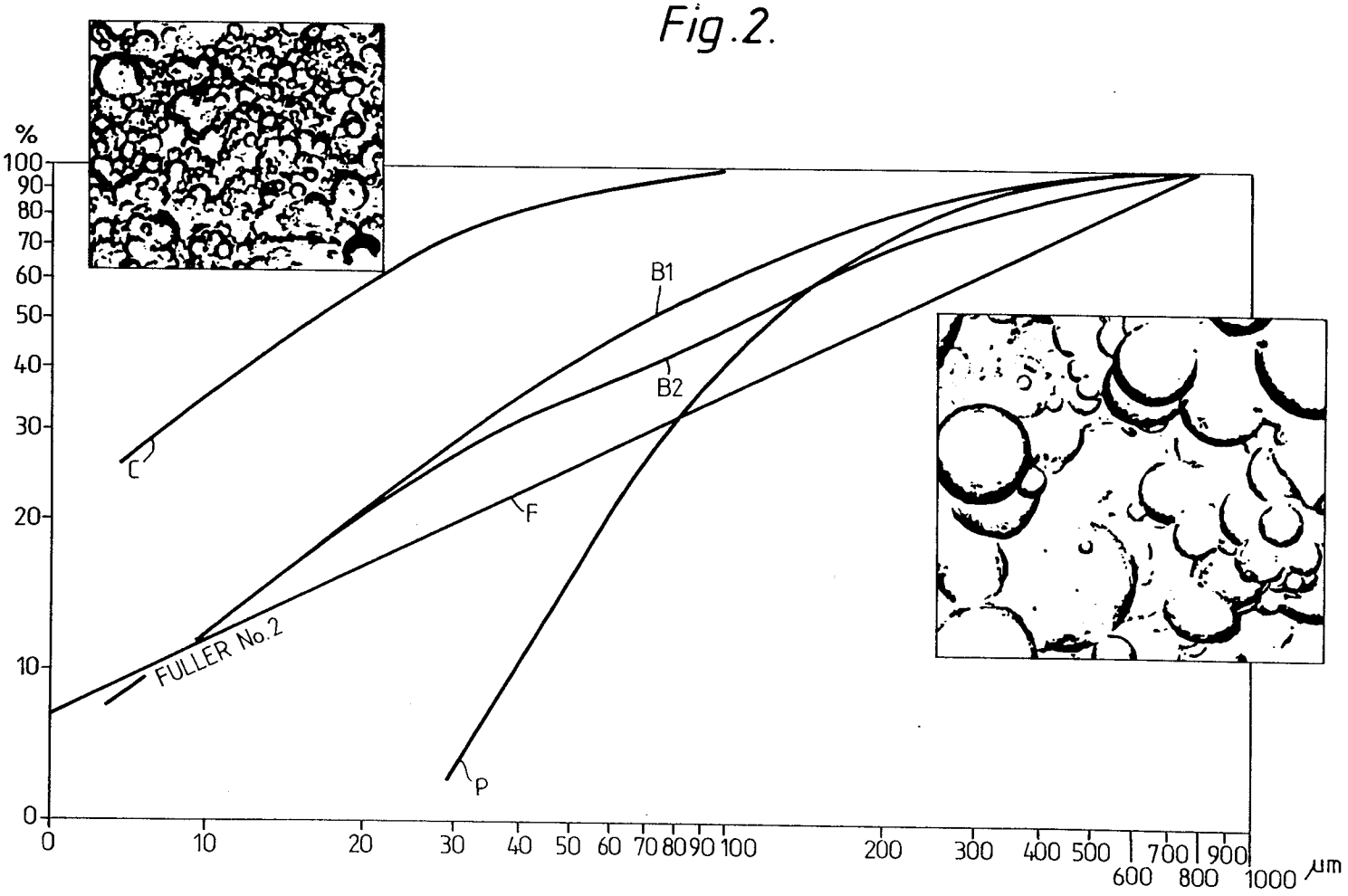
FIG. 2 shows in the form of a diagram the accumulated weight share as a function of particle size for some different powder fractions and mixtures of fractions.
Figure 4:
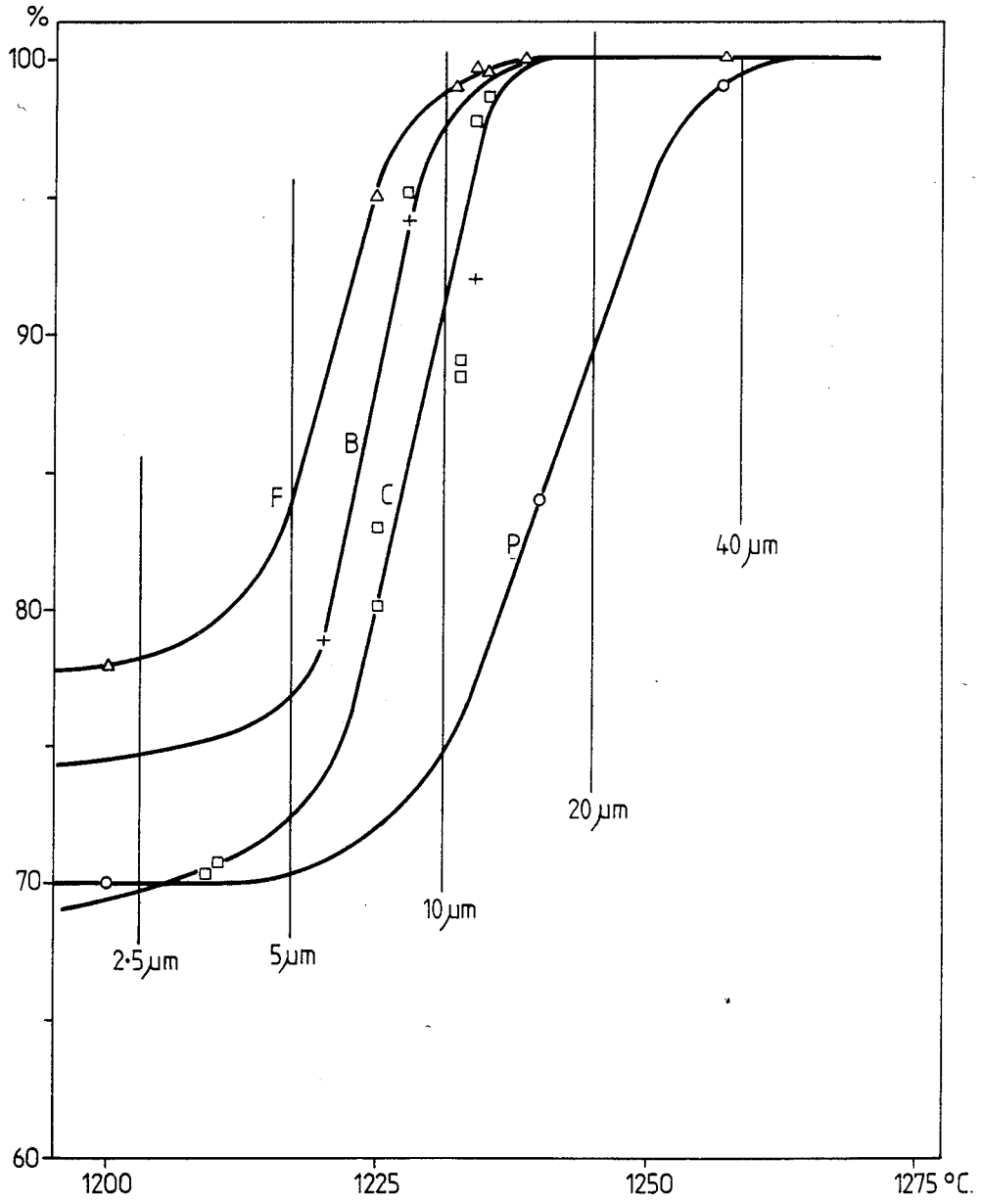
FIG. 4 shows a diagram illustrating how the relative density varies with the sintering temperature for different powder fractions or mixtures of fractions and how the growth of the carbide grains as related to the sintering temperature.

The experiment was carried out in the same way as Experiment 1 but the powder was magnetized before being poured into the form. The result was better, insofar as the stratification of coarser and finer material was eliminated. The whole surface of the sintered body was now coarse indicating that no dense packing had been accomplished. Curve B of FIG. 2 shows the accumulated weight share as a function of the particle size. As a result of the comparatively low degree of packing which is possible to obtain with pure production powder, about 69% relative density, the sintering must also be carried out at such a high temperature that it is not possible to eliminate carbide granule growth. This is illustrated in FIG. 4, where the curve P shows how the relative density increases with the sintering temperature. The diagram also shows that to obtain more than 95% relative density when sintering production powder it is unavoidable to reach such levels which produce carbides of about 20 μm, in other words larger than desirable.

EXPERIMENT 3

In this experiment pure cyclone powder was used, i.e. that powder which is separated as a fine particle fraction with particle sizes less than 100 μm in connection with production of ASP®-steel powder. The powder was magnetized, poured into a ceramic form and vacuum sintered according to the previous experiment. Before sintering the magnetized, packed powder at a relative density of about 66%, which by sintering at about 1235°–1240° C. could be increased to over 95% relative density. In this case also the carbide granules were starting to grow, however. This experiment is of a theoretical rather than practical interest, since this powder is not normally available in quantities necessary to support an industrial production by itself.

EXPERIMENT 4

A mixture of production and cyclone powder was sifted into twelve fractions, and material from these fractions was then mixed in the proportions indicated below to produce a No. 2 Fuller mixture for spherical powder, with about 77% relative density (filling density):

| | |
|---|---|
| <44 μm | 25% per weight |
| 44–63 μm | 3% per weight |
| 63–74 μm | 2% per weight |
| 74–105 μm | 5% per weight |
| 105–149 μm | 9% per weight |
| 149–177 μm | 3% per weight |
| 177–210 μm | 8% per weight |
| 210–297 μm | 9% per weight |
| 297–354 μm | 5% per weight |
| 354–420 μm | 6% per weight |
| 420–597 μm | 14% per weight |
| 597–800 μm | 11% per weight |

The powder was well mixed, magnetized, and poured into a ceramic form as above, and by composing the mixture as described and by the magnetisation the best distribution of fine and coarse powder was obtained, which gave the desired filling density of about 77%. The curve F in FIG. 2 corresponds to this ideal distribution.

The powder was then sintered in vacuum at a temperature of about 1225°–1230° C., which raised the relative density to over 95%. The carbide granules were no greater than 5 μm, i.e. no carbide granule growth took place.

EXPERIMENT 5

A powder mixture was made from ⅓ cyclone powder (less than 100 μm) and ⅔ production powder of the same type as described above, i.e. with a grain size less than 800 μm. The mixture was magnetized producing a relative density of 73%. The accumulated weight share as a function of particle size is illustrated by curve B1 of FIG. 2. The powder was sintered as in the previous experiment in a ceramic form in a vacuum oven. The sintering temperature was about 1230°–1235° C.

EXPERIMENT 6

A powder mixture was made from ⅓ cyclone powder and ⅔ production powder with a maximum particle size of 1.1 mm. FIG. 2 shows that this mixture, curve B2, is a closer approximate of the ideal Fuller curve, F, than the previous mixture B1. The B2 curve is clearly bicuspid, there are clearly two humps on the B2 curve, corresponding to the two powder fractions, the particle size distributions of which are further apart than those of the previous mixture, corresponding to curve B1.

EXPERIMENT 7

Figure 3:
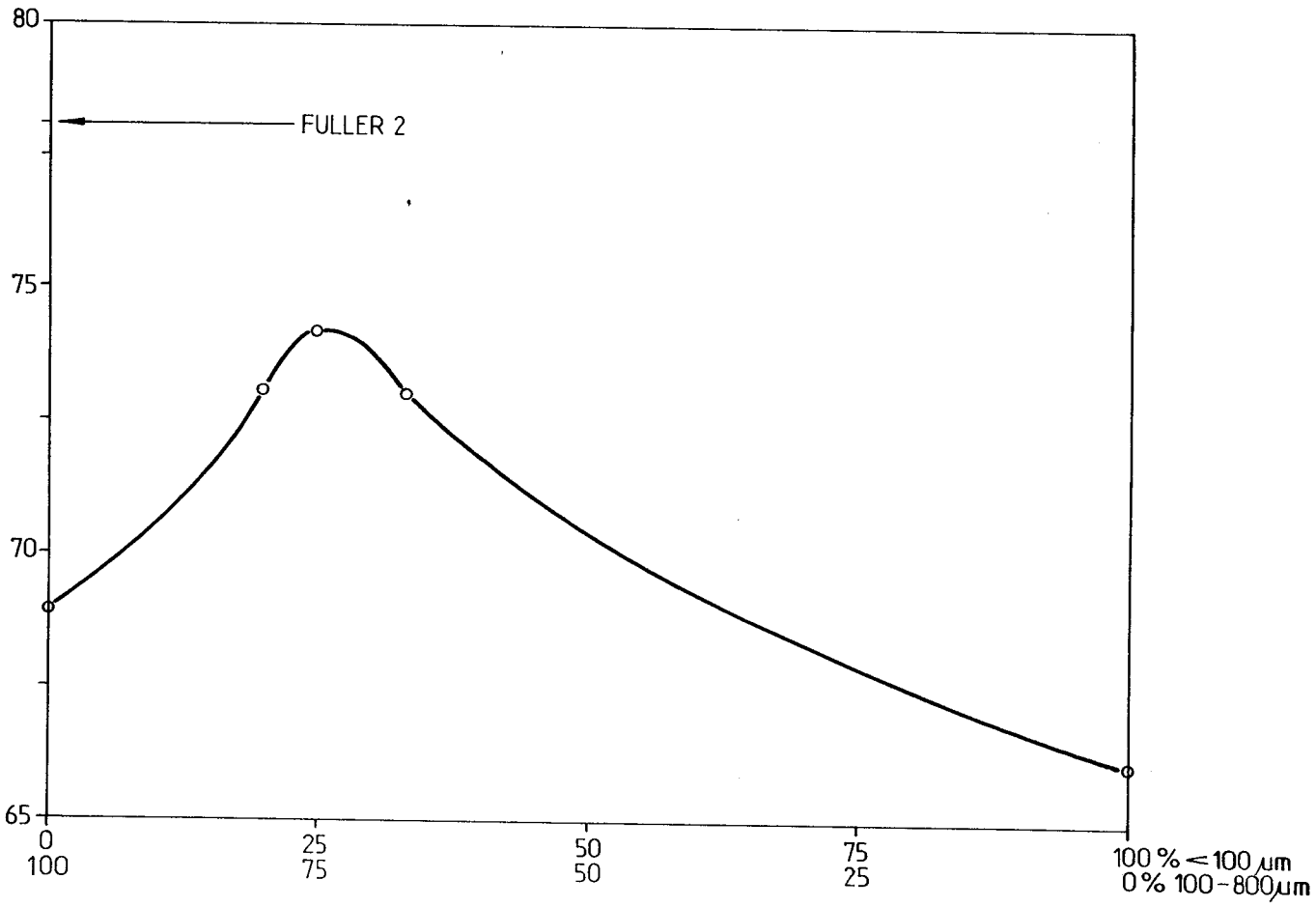
FIG. 3 shows in the form of a diagram the optimal filling density for different mixtures of two fractions of powder.

FIG. 3 illustrates the relative density or filling density of a powder composed from cyclone powder (no more than 100 μm) and production powder (no more than 800 μm). A maximum relative density, about 74%, is reached when the mixture contains 25% cyclone powder and 75% production powder. The relative density of a body made from the above mentioned magnetized powder mixture after sintering is shown in FIG. 4 as a function of the sintering temperature, curve B. The B curve closely approximates the curve of the Fuller mixture, in the critical temperature interval close to the solidus temperature of the material, i.e. in the temperature area 1225°–1235° C. In other words, with this powder mixture it is possible to achieve the desired density without communicating porosity while currently avoiding unacceptable carbide granule growth. The preceding Experiment 6 also shows that the packing density and consequently the sintering ability is further improved if a somewhat coarser powder constitutes the coarse fraction.

I claim:

1. A powder metallurgical method for producing metal bodies, wherein a particle size distribution closely approximating the so-called Fuller curve for maximum density packing of spherical particles is chosen of at least two powder fractions with different mean particle size relationship vis-a-vis each fraction, said powder being a spherical powder of magnetizable material produced by inert gas atomization, the powder is then magnetized and introduced into a container or the powder is magnetized after introduction in said container, said mixed and magnetized powder is sintered in said form with the exclusion of air at a temperature of about 25° C. from solidus temperature of said material and less, but at a sufficient temperature to effect said sintering so as to produce a sintered body of a density without communicating porosity.

2. The method according to claim 1, and wherein the ideal particle size distribution is approximated with a powder mixture composed of at least two powder fractions, the mean particle size relationship of which are $\overline{d1}/\overline{d2}$ between 5 and 15.

3. The method according to claim 1, and wherein the sintering is done at a temperature in the interval of 1200°–1250° C.

4. The method according to claim 1, and wherein the sintering is done at a temperature of more than about 25° C. from the solidus temperature of the material.

5. The method according to claim 1, and wherein the mixture is composed of two fractions, the coarser of which has a mean particle size between 100 and 200 μm and a maximum particle of 1.5 mm.

6. The method according to claim 1, and wherein the sintering is done in vacuum.

7. The method according to claim 1, and wherein the sintering is done in a nitrogen atmosphere.

8. The method according to claim 1, and wherein a powder mixture is produced with more than 70% relative density, said powder mixture is magnetized, and sintered to a relative density of at least 95%, and the sintered body thus produced is hot formed to full density.

* * * * *